US010325770B2

(12) United States Patent
Tirén et al.

(10) Patent No.: US 10,325,770 B2
(45) Date of Patent: Jun. 18, 2019

(54) FIELD EMISSION LIGHT SOURCE

(71) Applicants: Lightlab Sweden AB, Uppsala (SE); Nanyang Technological University, Singapore (SG)

(72) Inventors: Jonas Tirén, Uppsala (SE); Hilmi Volkan Demir, Singapore (SG)

(73) Assignees: Lightlab Sweden AB, Uppsala (SE); Nanyang Technological University, Singapore (SG)

( * ) Notice: Subject to any disclaimer, the term of this patent is extended or adjusted under 35 U.S.C. 154(b) by 0 days.

(21) Appl. No.: 15/535,767

(22) PCT Filed: Dec. 14, 2015

(86) PCT No.: PCT/EP2015/079583

§ 371 (c)(1),
(2) Date: Jun. 14, 2017

(87) PCT Pub. No.: WO2016/096717

PCT Pub. Date: Jun. 23, 2016

(65) Prior Publication Data

US 2017/0345640 A1 Nov. 30, 2017

(30) Foreign Application Priority Data

Dec. 17, 2014 (EP) ..... 14198645

(51) Int. Cl.
*H01J 63/02* (2006.01)
*H01J 63/06* (2006.01)
(Continued)

(52) U.S. Cl.
CPC ..... *H01J 63/02* (2013.01); *H01J 63/04* (2013.01); *H01J 63/06* (2013.01); *H01J 1/3044* (2013.01);
(Continued)

(58) Field of Classification Search
CPC .. H01J 17/00; H01J 1/312; H01J 63/02; H01J 63/04; H01J 63/06; H01J 63/30;
(Continued)

(56) References Cited

U.S. PATENT DOCUMENTS 5,455,489 A 10/1995 Bhargava
5,746,635 A * 5/1998 Spindt ..... H01J 9/185 445/24
(Continued)

FOREIGN PATENT DOCUMENTS

CN 102308669 A 1/2012
CN 103117205 A 5/2013
(Continued)

OTHER PUBLICATIONS

Vichy Bartlomiej et al., "Field-emission light sources utilizing carbon nanotubes and composite phosphor made of SiO2 nanospheres covered with Y203: Eu", Journal of Vacuum Science and Technology: Part B, AVSIAIP, Melville, New York, NY, US, vol. 27, No. 2, Mar. 27, 2009.
(Continued)

*Primary Examiner* — Thai Pham
(74) *Attorney, Agent, or Firm* — RMCK Law Group, PLC

(57) ABSTRACT

The present invention generally relates to a field emission light source and specifically to a miniaturized field emission light source that is possible to manufacture in large volumes at low cost using the concept of wafer level manufacturing, i.e., a similar approach as used by integrated circuits (IC) and microelectromechanical systems (MEMS). The invention also relates to a lighting arrangement comprising at least one field emission light source.

20 Claims, 6 Drawing Sheets

(51) Int. Cl.
*H01J 1/304* (2006.01)
*H01J 63/04* (2006.01)
*H01J 61/30* (2006.01)

(52) U.S. Cl.
CPC ..... *H01J 61/30* (2013.01); *H01J 2893/0031* (2013.01)

(58) Field of Classification Search
CPC .. H01J 2893/0031; H01J 1/304; H01J 1/3044; H01J 1/36; H05B 41/042; B82Y 10/00
USPC ..... 315/326; 313/325, 326, 574, 310, 311; 445/51, 29; 327/602; 250/393, 493.1, 250/504 R; 252/500
See application file for complete search history.

(56) References Cited

U.S. PATENT DOCUMENTS

| | | | | |
|---|---|---|---|---|
| 2007/0063630 | A1* | 3/2007 | Guo | B82Y 10/00 313/311 |
| 2008/0157646 | A1 | 7/2008 | Chen et al. | |
| 2011/0297846 | A1* | 12/2011 | Wang | H01J 63/06 250/459.1 |
| 2014/0055027 | A1* | 2/2014 | Ger | H01J 9/025 313/496 |
| 2014/0211451 | A1* | 7/2014 | Wang | H01J 1/304 362/97.1 |

FOREIGN PATENT DOCUMENTS

| | | | |
|---|---|---|---|
| EP | 1246263 | A2 | 10/2002 |
| EP | 1246263 | A3 | 10/2002 |
| EP | 1876387 | A1 | 1/2008 |
| JP | 2006253125 | A | 9/2006 |
| JP | 2008166245 | A | 7/2008 |
| JP | 2010211955 | A | 9/2010 |
| JP | 2012124086 | A | 6/2012 |
| JP | 2013016498 | A | 1/2013 |
| JP | 2013524452 | A | 6/2013 |
| JP | 2013545248 | A | 12/2013 |
| WO | 2007114655 | A1 | 10/2007 |
| WO | 2011124555 | A1 | 10/2011 |
| WO | 2012075384 | A2 | 6/2012 |
| WO | 2014173821 | A1 | 10/2014 |

OTHER PUBLICATIONS

European Search Report for EP Application No. 14198645.5 dated Jun. 17, 2015, 10 pages.
Gorecka-Drzazga, A., et al., "Field-emission light sources for lab-on-a-chip microdevices", Bulletin of the Polish Academy of Sciences, Technical Sciences, vol. 60, No. 1, dated Jan. 1, 2012.
International Search Report and Written Opinion for International Application No. PCT/EP2015/079583 dated Apr. 11, 2016, 19 pages.
Chinese Office Action for CN Application No. 201580073512.3 dated Jun. 4, 2018 with English translation, 12 pages.
Japanese Office Action for JP Application No. 2017-533345 dated May 29, 2018, 7 pages.

* cited by examiner

FIELD EMISSION LIGHT SOURCE

CROSS-REFERENCE TO RELATED APPLICATIONS

This application is a 371 U.S. National Stage of International Application No. PCT/EP2015/079583, filed Dec. 14, 2015, which claims priority to European Application No. 14198645.5, filed on Dec. 17, 2014. The disclosures of each of the above applications are incorporated herein by reference in their entirety.

TECHNICAL FIELD

The present invention generally relates to a field emission light source and specifically to a miniaturized field emission light source that is possible to manufacture in large volumes at low cost using the concept of wafer level manufacturing, i.e. a similar approach as used by IC's and MEMS. The invention also relates to a lighting arrangement comprising at least one field emission light source.

BACKGROUND OF THE INVENTION

The technology used in modern energy saving lighting devices uses mercury as one of the active components. As mercury harms the environment, extensive research is done to overcome the complicated technical difficulties associated with energy saving, mercury-free lighting. Today, LED has emerged strongly, however this technology is made in very advanced semiconductor factories ("FAB"s) utilizing very costly equipment. In addition the LED technology today is struggling to achieve commercially attractive solutions for the deep UV (UVC) region as some fundamental physical issues are impeding the development.

An approach used for solving this problem is by using field emission light source technology. Field emission is a phenomenon which occurs when a very high electric field is applied to the surface of a conducting material. This field will give electrons enough energy such that the electrons are emitted (into vacuum) from the material.

In prior art devices, a cathode is arranged in an evacuated chamber, having for example glass walls, wherein the chamber on its inside is coated with an electrically conductive anode layer. Furthermore, a light emitting layer is deposited on the anode. When a high enough potential difference is applied between the cathode and the anode thereby creating high enough electrical field strength, electrons are emitted from the cathode and accelerated towards the anode. As the electrons strike the light emitting layer, typically comprising a light powder, the light powder will emit photons. This process is referred to as cathodoluminescence.

One example of a light source applying field emission light source technology is disclosed in EP1709665. EP1709665 disclose a bulb shaped light source comprising a centrally arranged field emission cathode, further comprising an anode layer arranged on an inside surface of a glass bulb enclosing the field emission cathode. The disclosed field emission light source allows for omnidirectional emission of light, for example useful in relation to a retrofit light source implementation.

Even though the EP1709665 shows a promising approach to a mercury free light source, it would be desirable to provide an alternative to the disclosed bulb structure, possibly allowing for enhanced manufacturing and thus reduced cost for the resulting light source. In addition, the manufacturing of a three-dimensional field emission light source as is shown in EP1709665 is typically someway cumbersome, specifically for achieving a high level of uniformity in regards to light emission.

"Field-emission light sources for lab-on-a-chip microdevices" by A. Górecka-Drzazga et. al., Bulletin of the polish academy of sciences technical sciences, Vol. 60, No. 1, 2012, disclose an interesting approach for overcoming the problems described. Specifically, there is disclosed a field emission chip comprising a nanostructured cathode.

Further attention is drawn to US20110297846, disclosing methods and devices for producing light by injecting electrons from field emission cathode across a gap into nanostructured semiconductor materials, electrons issue from a separate field emitter cathode and are accelerated by a voltage across a gap towards the surface of the nanostructured material that forms part of the anode.

However, the disclosed microdevices are not suitable as commercially viable light sources, that is, a lighting scenario not limited to short illumination cycles as would be the case of in relation to the above reference. There is thus a desire to provide further enhancements to a field emission light source, typically adapted for general purpose lighting and deep UV (UVC) light sources.

SUMMARY OF THE INVENTION

According to an aspect of the invention, the above is at least partly alleviated by a miniaturized field emission light source, comprising a field emission cathode comprising a plurality of nanostructures formed on a substrate, an electrically conductive anode structure comprising a first wavelength converting material arranged to cover at least a portion of the anode structure, wherein the first wavelength converting material is configured to receive electrons emitted from the field emission cathode and to emit light of a first wavelength range, and means for forming an hermetically sealed and subsequently evacuated cavity between the substrate of the field emission cathode and the anode structure, including a spacer structure arranged to encircle the plurality of nanostructures, wherein the substrate for receiving the plurality of nanostructures is a wafer.

The field emission light source according to the invention may typically be manufactured using a two-dimensional planar process similar to the one used in the manufacturing of integrated circuits (IC's) and MEMS (Micro Electro Mechanical Systems). Preferably an essentially flat wafer may be provided, and the plurality of nanostructures may be formed thereon, for example using a wet (hydrothermal) chemical process, by oxidation, chemical vapor deposition techniques or by electro deposition. Other methods are equally possible. In an embodiment, the anode structure may be formed on another essentially flat wafer. It is important to distinguish the wafer in this context, i.e. a wafer of essentially the size of an individual device, from the size of the wafer used in the wafer scale manufacturing process, the latter much larger and contain a large number of separate devices.

Further advantages generally following from the present invention include the possibility of using a modular manufacturing process where e.g. the anode and cathode structures may be manufactured in large numbers on separate wafers and then combined in a subsequent bonding process. In the subsequent bonding process, cathode and anode wafers are aligned and joined together to form the individual field emission light sources. Accordingly, the subsequent evacuation (creating a vacuum) may be achieved when performing the bonding process, using a spacer structure, which also may be supplied as a third large wafer or as separate elements In accordance to the invention, the first wavelength converting material is arranged, during operation of the field emission light source, to receive electrons emitted/accelerated from the plurality of nanostructures in a direction towards the anode structure. Once the first wavelength converting material receives the electrons, light within the first wavelength range will be emitted. Preferably, the first wavelength material is selected to have low temperature quenching. In addition, the first wavelength converting material is preferably applied to at least a major portion of the anode structure. Within the scope of the invention, the first wavelength range may be selected broad (for emitting essentially white light), a wavelength range covering a "single color", or being a mix of a plurality of frequency rangers (not necessarily being connected). The first wavelength material may also be configured to emit UV light. A field emission light source emitting UV light may in an embodiment be arranged for curing an adhesive ("glue"), for disinfection of water, air, surfaces, etc.

A spacer structure is arranged to encircle the plurality of nanostructures, thereby arranging the anode structure in a controlled manner in a close vicinity of the field emission cathode. The spacer structure will in such an embodiment be part in forming the cavity between the anode structure and the field emission cathode. It may as an alternatively to a spacer structures be possible to form a depression within the wafer for achieving the desired cavity. Accordingly, the spacer structure and/or the depression will set a predetermined distance between the anode structure and the field emission cathode. It is desirable to select the spacer to have a thermal expansion (coefficient) matching the wafer, and typically also the anode structure.

By accurately being able to control the distance between the anode structure and the field emission cathode, as compared to what for example is possible in relation to a bulb, tube or flat (but much larger) shaped field emission light source, an optimized electrical voltage potential necessary for allowing emission of electrons between the field emission cathode and the anode structure may be achieved. This may possibly allow for a further optimization as to the energy efficiency the field emission light source. In a possible embodiment of the invention, the distance between the substrate of the field emission cathode and the anode structure is preferably between 100 μm and 5000 μm.

The wafer for one device as disclosed here may in a possible embodiment have a width of 1-100 millimeters (may e.g. be circular or rectangular). (For clarity, the invention describes a device that may be produced in large numbers on a single large substrate, typically 200-1000 mm, the large substrate then containing large numbers of individual devices) The wafer may in one embodiment of the invention be a silicon wafer. The cathode wafer may alternatively comprise a metal substrate. In addition, the wafer may alternatively be formed from an insulating material provided with an electrically conductive layer. In a preferred embodiment, the insulating material may be transparent, for example glass, specifically with the same thermal characteristics as the anode glass. In this embodiment it advantageous to use the same material also for the spacer element since this approach will give minimum mismatch of the thermal expansion coefficients and thus minimal residual stress due to thermal cycles in manufacturing as well as operation. Similarly, the anode structure may in one embodiment preferably be transparent, formed e.g. from a glass material. The glass should preferably be sufficiently thin for obtaining a low level of leaky optical modes while still preferably being thick enough to provide an effective barrier against oxygen, other gases and humidity, as the permeation of such gases would deteriorate the encapsulated vacuum which eventually would lead to a nonfunctioning device.

Using e.g. a borosilicate glass for the anode is preferred, as such glass materials are designed to be able to be sealed with corresponding metal alloys, and a common example brand name is Kovar. They may also seal well to Tungsten (W). Sealing techniques include vacuum brazing, glass frits (glass powders) and eutectic bonding under high pressure. It should be noted that using all (relevant) parts made by the same glass type (or at least very similar) may be beneficial as the thermal coefficients of expansion (TCEs) are identical or very close.

In addition and in regards to thermal expansion of the selected materials, during the sealing procedure of the component, materials may be exposed to temperatures up to 900° C. If the different materials have different coefficients of thermal expansion, they will expand at different rates. This may introduce mechanical stress and warping (especially when going for a wafer scale production) with possible issues such as micro leakage and breakage as a result. Thus materials must be chosen to minimize this, as well as the methods of joining them.

Still further and in regards to dielectric strength, the structure may be powered using a voltage of up to at least 10 kV. As such, the materials in the spacer element and preferably the anode must be able to withstand a high voltage or electrical breakdown may occur. In addition, dielectric strength must be considered in the geometrical design, meaning that sharp corners where field crowding may occur should be avoided; limiting the occurrence of locally amplified electrical fields, which may cause arcing and parasitic currents.

In addition and in regards to gas permeation through materials and seals, despite the use of deposits of reactive material that is placed inside a vacuum system for the purpose of completing and maintaining the vacuum (getters), gas permeation through the material must be considered. For glass components, the properties for helium gas must be given special attention as the getters is not be able to pump noble gases and since helium is known to permeate through certain types of glass and quartz. In addition, seals must be chosen for materials, methods and design to allow for adequately low leakage rates.

In some embodiments it may be preferred to use a metal material as the wafer. A metal wafer has the advantages of better handling of the needed vacuum within evacuated cavity between the substrate of the field emission cathode and the anode structure. That is, the metal wafer will provide lower gas permeation to the cavity as compared to other types of materials, e.g. glass and quartz, possible to use in regards to the wafer. In addition, a metal wafer is advantageous in that it is electrically conductive, thus providing a direct electrical contact to the cathode. In a possible embodiment, the wafer is a semiconductor wafer having a conductive layer, either metallic or by doping. Accordingly, it should be understood that the expression "wafer" is used broadly within the scope of the invention.

Within the context of the invention, the electrically conductive layer may generally be defined as comprising a transparent conductive oxide (TCO). In a possible embodiment, the electrically conductive layer comprises an indium tin oxide (ITO) layer. The electrically conducting layer may in an alternative configuration be formed by a metallic layer, preferably of an element with a low density, preferably aluminum. A combination of the two is also possible and within the scope of the invention.

Light will generally be allowed to pass "through" the anode structure during operation of a field emission light source, i.e. in the case where the anode structure is formed from a glass material provided with the electrically conductive layer. As alternative, a transparent wafer may be provided in relation to the cathode, and the field emission light source may thereby be formed in an "upside down manner", i.e. where light is emitted from the field emission light source "through" the cathode (rather than through the anode structure). The field emission cathode may in such a case be defined as a transmissive field emission cathode. The field emission cathode structure is preferably in such an embodiment provided with the transparent electrically conductive material as mentioned above.

Preferably, the evacuated cavity has a pressure of less than $10^{-3}$ Torr to avoid issues with degradation, lifetime arcing and similar phenomena associated with a poor vacuum in field emission light sources In accordance to the invention it is preferred to include also a second wavelength converting material. The second wavelength material is configured for activation by means of light (photoluminescence) rather than by reception of electrons. In a preferred embodiment the second wavelength converting material is adapted to receive light generated by the first wavelength converting material, the received light being within the first wavelength range. As a result, the second wavelength converting material emits light within a second wavelength range, where the second wavelength range is at least partly higher than the first wavelength range. An advantage following the suggested implementation allows for an emission of light from the field emission light source ranging over both the first and the second wavelength range.

In a preferred embodiment, the first wavelength range is between 350 nm and 550 nm, preferably between 420 nm and 495 nm. Furthermore, the second wavelength range is preferably selected to be between 470 nm and 800 nm, preferably between 490 nm and 780 nm. Accordingly, in a preferred implementation of the invention the light collectively emitted by the field emission light source is between 350 nm-800 nm, preferably between 450 nm-780 nm. Accordingly, the field emission light source according to the invention may be configured for emission of white light. A special case would be for the first wavelength range to lie in the ultraviolet region, from 160 nm to 400 nm, intended for applications as mentioned above.

It should be noted that it within the scope of the invention may be possible to allow the field emission light source to comprise also a third wavelength converting material. In a possible embodiment of the invention, the second and the third wavelength converting material may be configured to be activated by means of light emitted from the first wavelength converting material (i.e. within the first wavelength range). The third wavelength converting material may also or alternatively be configured to be activated by light emitted by the second wavelength converting material (i.e. the second wavelength range).

It may in accordance to the invention be advantageous to arrange the second (and third, etc.) wavelength converting material remotely from the anode structure outside of the evacuated cavity (where the majority of heat is generated during operation of the field emission light source). The temperature quenching of the second (and third) wavelength converting material may thereby be greatly reduced. It may in such an embodiment be preferred to form an "external transparent structure" outside of the field emission light source. The inside of such the external transparent structure may in this embodiment be provided with the second wavelength converting material. The external transparent structure may in a possible embodiment have a dome shape to enhance the light extraction. In a further embodiment, the surface of the transparent structure may also include nanofeatures, such as nanosized patterns (e.g. nanopillars, nanocones, nanospheres, nanoscale rough surface etc.) for increased light outcoupling.

The presented embodiments of the invention solves fundamental issues not handled by prior art. Firstly, heat management (e.g. comprising heat dissipation) will in accordance to the invention be improved. Secondly, in a field emission light source to be used for general lighting, i.e. emitting an essentially white light, a mix of different wavelength converting materials should preferable be used to achieve a desired correlated color temperature (CCT) and Color Rendering Index (CRI), where the CRI preferably is above 90. This in turn will lead to issues in light extraction as these different wavelength converting materials emit different wavelengths. The different wavelengths and materials may, for example, lead to different requirements on matching of refractive indices. This may in accordance to the invention be handled by separation of the first and the second wavelength converting material, allowing optimization for light extraction, thereby allowing significantly enhanced energy efficiency.

Thirdly, a chip based UV chip based light source with commercially attractive performance may be realized by using a UV generating first wavelength material and corresponding UV transmissive parts. Furthermore, the invention will allow for large scale manufacturing of commercially attractive, reliable chip based light sources that are able to operate for long periods of time.

In a preferred embodiment of the invention, the first wavelength converting material comprises a phosphor material. It may in one embodiment be possible to select a phosphor material configured to receive electrons and to emit light within the blue wavelength range. It should be noted that the first wavelength converting material in one embodiment may comprise a mono crystalline phosphor layer. Preferably, UV or blue light is emitted. Alternatively, the first wavelength converting material may comprise a phosphor suitable for solid state lighting such as in relation to a light emitting device (LED). A traditional cathodoluminescent phosphor material comprised with the first wavelength converting material may for example be ZnS:Ag,Cl. Such a traditional cathodoluminescent material may be made very energy efficient. Another example of a highly efficient material emitting light in the near UV range is $SrI_2$:Eu. As to deep UV $LuPO_4$:Pr may be a good choice.

In another preferred embodiment the second wavelength converting material may comprise quantum dots. The use of quantum dots has shown a highly promising approach as light emitters. In addition, synthesis of quantum dots may be made easier at higher wavelengths, typically above the wavelength range where blue light is emitted. Thus, in accordance to the invention a synergistic effect may be achieved where a phosphor material of the first wavelength converting material generates blue light and quantum dots of the second wavelength converting material generates light within a wavelength spectra with higher wavelengths, typically generating green and red light. By allowing light generated by the first and the second wavelength material to mix, white light may be generated.

It should be noted that also the second wavelength converting material within the scope of the invention as an alternative may comprise a phosphor material. Alternatively, the first wavelength converting material may comprise a phosphor suitable for solid state lighting such as in relation to a light emitting device (LED). In an embodiment, a second and a third phosphor material may be mixed together forming the second wavelength converting material.

Generally, the phosphor material(s) comprised with the wavelength converting material(s) may e.g. be applied by sedimentation, disperse dispensing, printing, spraying, dip-coating and conformal coating methods. Other methods are possible and within the scope of the invention, in particular if forming essentially monocrystalline layers, including thermal evaporation, sputtering, chemical vapor deposition or molecular beam epitaxy. Additional known and future methods are within the scope of the invention.

Furthermore, the field emission light source may additionally comprise reflective features for minimizing light emission losses. In one preferred embodiment these reflective features may be achieved by a reflective layer being positioned under the plurality of nanostructures. Another preferred embodiment is to place the reflective layer on top of the anode, and on top of the wavelength converting material(s). In the latter case the reflective layer must be thin enough and the electron energy must be high enough so that the electrons to a major extent will penetrate the reflective layer and deposit the majority of their energy into the wavelength converting material(s). Another advantage of this configuration is that the reflective layer also may protect the underlying light converting material from decomposition.

It should be understood that reflectance may be achieved using different means. In may, in accordance to the invention, be possible to use a thin metal layer for allowing light reflectance. In another embodiment the reflectance is made possible by the provision of the above mentioned electrically conductive layer (e.g. being of a metallic material).

In a preferred embodiment of the invention the wafer comprises a recess, and the nanostructures are formed within the recess. The recess may have curved (e.g. parabolic, hyperbolic or similar) shaped side sections and an essentially flat bottom where the nanostructures are formed. In a possible embodiment at least the side sections are provided with a reflective coating for reflecting light out from the field emission light source. The side sections may in an alternative embodiment have flat side sections. The shape of the side sections may be selected to maximize light emitted out from the field emission light source. In an embodiment also the flat bottom of the recess is provided with a reflective coating.

As mentioned above, the depth of the recess or the height of the spacer structure or the combination of both may as mentioned above be selected to optimize the operational point of the field emission light source, i.e. in relation to voltage/current used for desired field emission from the nanostructures. It may further be possible to select the combined depth of the recess in combination with the height of the spacer such that at least a portion of the plurality of nanostructures comes in direct contact with the first wavelength converting material, as such providing a direct injection of electrons to the first wavelength converting material.

In the present context, nanostructures may for example include nanotubes, nanorods, nanowires, nanopencils, nanospikes, nanoflowers, nanobelts, nanoneedles, nanodisks, nanowalls, nanofibres and nanospheres. Furthermore, the nanostructures may also be formed by bundles of any of the aforementioned structures. According to one embodiment of the invention the nanostructures may comprise ZnO nanorods.

According to an alternative embodiment of the invention the nanostructure may include carbon nanotubes. Carbon nanotubes may be suitable as field emitter nanostructures in part due to their elongated shape which may concentrate and produce a higher electric field at their tips and also due to their electrical properties.

Furthermore, it should be understood that when a significant voltage is applied between the anode and the cathode for operation of the field emission light source, care must be taken to ensure electrical isolation between the parts. This isolation may for example be done by using an isolating material in the spacer structure. The spacer structure may for example be formed from alumina, glass (e.g. borosilicate glass, sodalime glass, quartz and sapphire), pyrolytic boron nitride (pBN) and similar materials. As heat transfer may in some cases be especially important, transparent materials with relatively high heat conducting properties may be preferred. Examples of such materials are sapphire and aluminosilicate glass, the latter being essentially a borosilicate glass with comparably large amounts of Alumina ($Al_2O_3$), usually in the order of 20%. Another way is to use the oxide of one of the wafers, providing this is suitable as is the cases for example for silicon, at least to moderate voltages.

In an embodiment a suitable isolating spacer structure could be certain grades of alumina, boron nitride, certain nitrides and so forth. The possible selection is large for isolating materials. In addition, the materials for the different substrates (e.g. the cathode substrate, the anode substrate and so forth) are preferably chosen to have similar coefficients of thermal expansion (CTE). As an example, borosilicate glass has a typical CTE of around 3-5 um/m/deg C. This may advantageously be used as a transmissive window, e.g. in relation to the above mentioned anode/cathode structure. In the special case of a deep UV transmitting light source materials such as quartz/fused silica, soda lime and borosilicate may be used as an example for a UVC transmitting borosilicate is the type 8337B by Schott AG. There are several suitable isolating materials with similar CTE. Metallic parts are less common; essentially those are tungsten, tungsten alloys, Molybdenum and Zirconium. The use of Zirconium would have an interesting aspect in the sense that this material could be used as a getter at the same time. A specially designed alloy, Kovar® (a nickel-cobalt ferrous alloy) is in some cases a good alternative; borosilicate glass with the same trade name is available from Corning Inc, e.g. Kovar Sealing Glass 7056. The joining of the parts may be done by using glass frits, vacuum brazing, anodic bonding, fusion bonding. Other methods are equally possible. The joint should be hermetic and preferably only induce marginal additional stress into the structure. In some cases the joining may also be used for stress relief. The choice of materials must further address hermeticity and gas permeability.

The field emission light source as discussed above preferably forms part of a lighting arrangement further comprising a power supply for supplying electrical energy to the field emission light source for allowing emission of electrons from the plurality of nanostructures towards the anode structure, and a control unit for controlling the operation of the lighting arrangement. The control unit is preferably configured to adaptively control the power supply such that the lighting arrangement emits light having a desired intensity. A sensor may be provided for measure an instantaneous intensity level and provide feedback signal to the control unit, where the control unit controls the intensity level dependent on the instantaneous intensity level and the desired intensity level. The power supply is preferably a DC power supply applying a switched mode structure and further comprising a voltage multiplier for applying a desired voltage level to the field emission light source. In a preferred embodiment the power supply is configured to apply between 0.1-10 kV to the field emission light source. Alternatively a pulsed DC may be advantageous.

In a possible embodiment of the invention, either the substrate comprises the first wavelength converting material or the field emission cathode nanostructures are made out of silicon. In this case, the functionality, or part of the functionality performed by the control unit may be integrated within the substrate comprising the silicon wafer. Thus, in accordance to the invention, a single silicon wafer may comprise both the nanostructures and the functionality for controlling the field emission light source. The process of manufacturing, integration and control of the field emission light source may accordingly be improved as compared to prior art. In a possible embodiment of the invention a CMOS fabrication process is performed for forming at least part of the control unit functionality as mentioned above onto the wafer.

From a general perspective, once the different mentioned wafers mentioned above have been joined together and a vacuum established, the field emission light source according to the invention may further typically be diced into separate singular light sources and subsequently assembled in a similar manner as packaging LED chips i.e. in a fully automated setting only including a minimum amount of manual labor as compared to what is generally common when manufacturing a bulb shaped field emission light source. The dicing is commonly done so that rectangular (or square) dies are obtained. In one alternative preferred embodiment the dicing is done so that hexagonally shaped dies are created.

The above description of the inventive field emission cathode has been made in relation to a diode structure comprising a field emission cathode and an anode structure. It could however be possible to and within the scope of the invention to arrange the field emission light source as a triode structure, for example comprising at least an additional control electrode. The control electrode may be provided for increasing the extraction of electrons from the field emission cathode. In addition, it may be possible and within the scope of the invention to also comprise a getter with the field emission light source.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
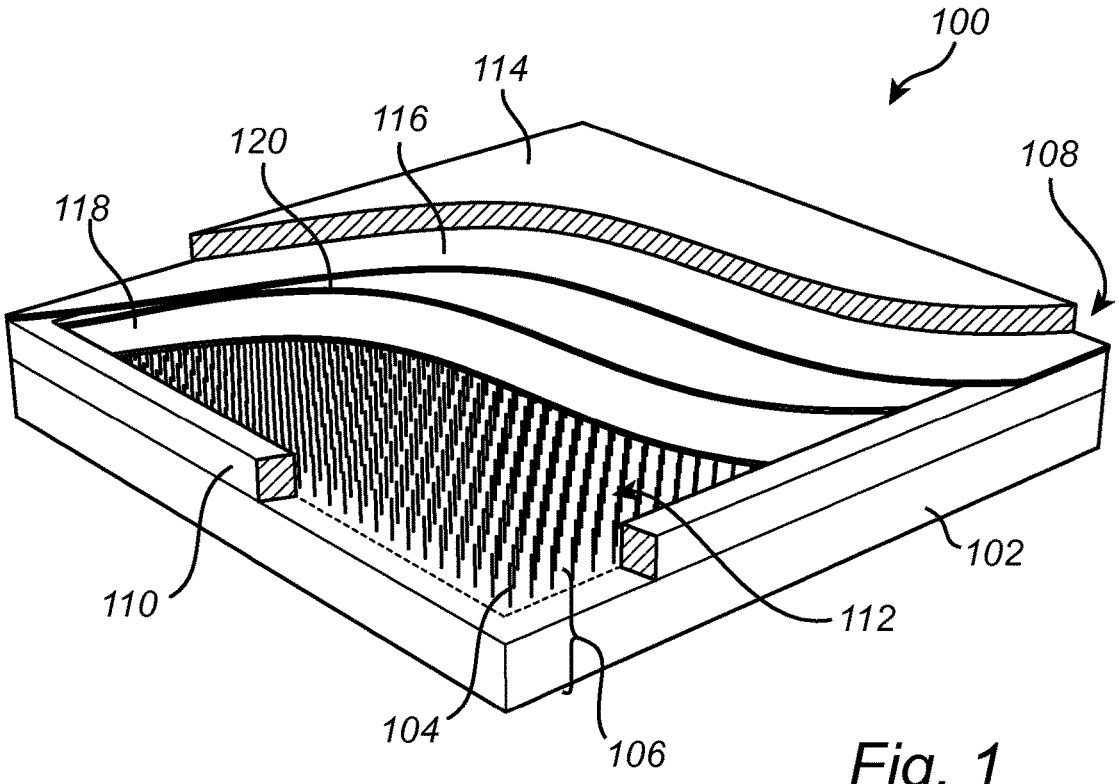
FIG. 1 illustrates a perspective view of a field emission light source according to a currently preferred embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is illustrated a field emission light source 100 according to a preferred embodiment of the invention. The field emission light source 100 comprises a wafer 102 provided with a plurality of ZnO nanorods 104 having a length of at least 1 um, the wafer and plurality of ZnO nanorods 104 together forming a field emission cathode 106. In a possible embodiment the ZnO nanorods may be selectively arranged onto spaced protrusions (not shown). It may also, as an alternative, be possible to substitute the ZnO nanorods 104 for carbon nanotubes (CNT, not shown). Other emitter materials are equally possible and within scope of the invention. The field emission light source 100 further comprises an anode structure 108 arranged in close vicinity of the field emission cathode 106.

The distance between the field emission cathode 106 and the anode structure 108 in the current embodiment is achieved by arranging a spacer structure 110 between the field emission cathode 106 and the anode structure 108, where a distance between the field emission cathode 106 and the anode structure 108 preferably is between 100 um to 5000 um. The cavity 112 formed between the field emission cathode 106 and the anode structure 108 is evacuated, thereby forming a vacuum between the field emission cathode 106 and the anode structure 108.

The anode structure 108 comprises a transparent substrate, such as a planar glass structure 114. Other transparent materials are equally possible and within the scope of the invention. Examples of such materials are quartz and sapphire. The transparent structure 114 is in turn provided with an electrically conductive and at least partly transparent anode layer, typically a transparent conductive oxide (TCO) layer, such as an indium tin oxide (ITO) layer 116. The thickness of the layer 116 is selected to allow maximum transparency with a low enough electrical resistance. In a preferred embodiment the transparency is selected to be above 90%. The layer 116 may be applied to the glass structure 114 using any conventional method known to the skilled person, such as sputtering or deposition by solvent, or screen-printing. As will be discussed below, the electrically conductive anode layer 116 may take different shapes and forms depending on the implementation at hand.

Figure 2A:
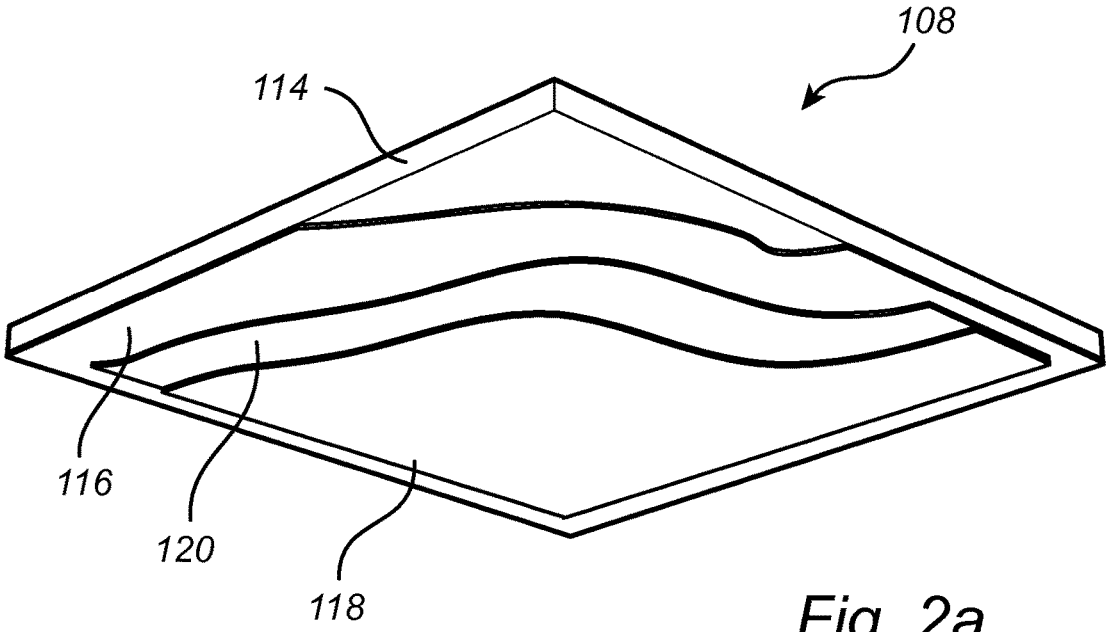
FIGS. 2*a* and 2*b* provides exemplary implementations of arranging a first and a second wavelength converting material at an anode structure of the field emission light source of FIG. 1.
Figure 2B:
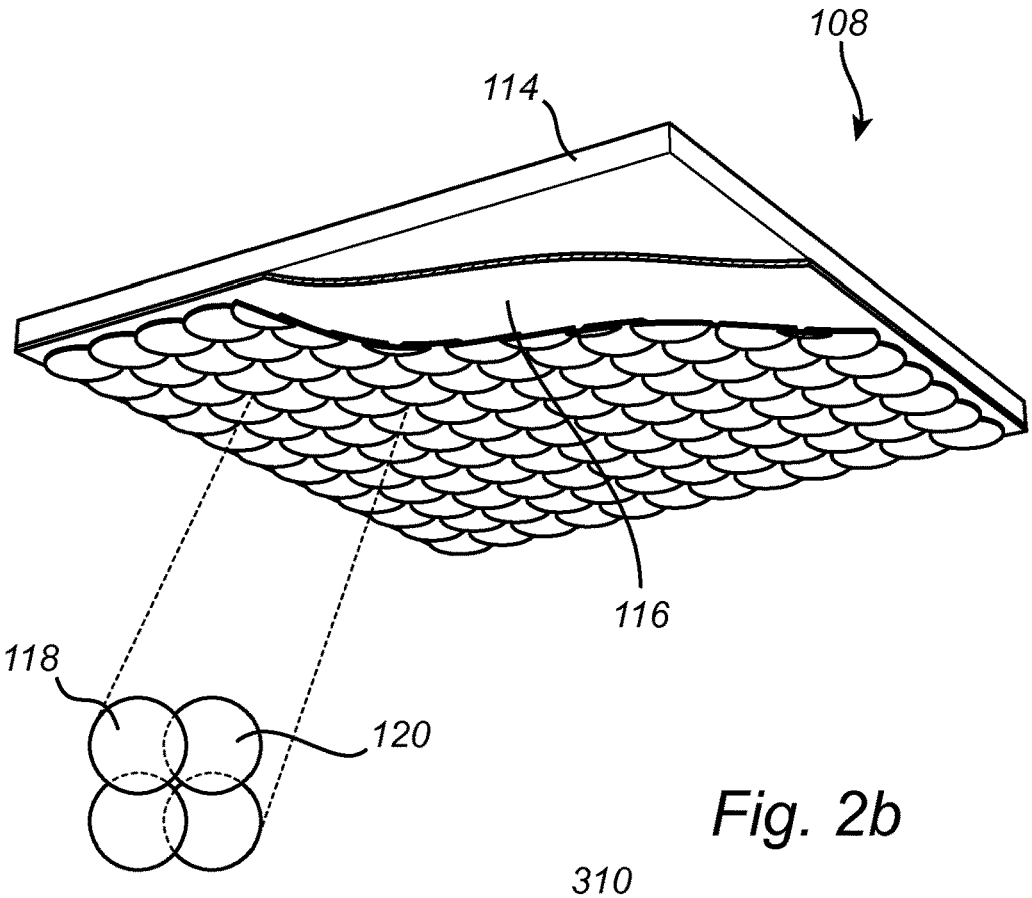

In accordance to the present embodiment, the layer 116 is provided with a first 118 and a second 120 wavelength converting material. With further reference to FIGS. 2*a* and 2*b*, the wavelength range converting materials 118, 120 may be formed onto the layer 116 in different ways. In FIG. 2*a* the second wavelength converting material 120 is formed directly adjacent to and on top of the ITO layer 116, and the first wavelength converting material 118 is formed directly adjacently and on top of the second wavelength converting material 120. This embodiment, i.e. shown in FIG. 2*a*, may be advantageous as it allows for a simplified manufacturing process where the different layers (i.e. layer 116, second wavelength converting material 120 and then the first wavelength converting material 118) subsequently are arranged onto the glass structure 114. It should be noted that the glass structure 114 not necessarily has to be planar.

Figure 3:
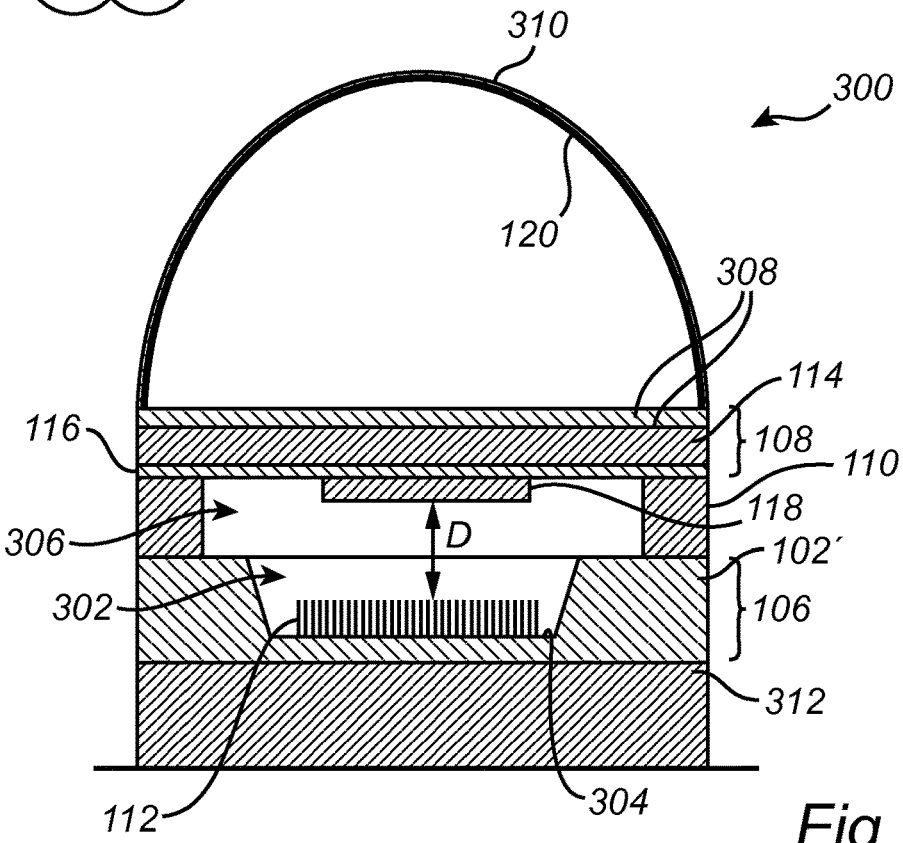
FIG. 3 illustrates an alternative implementation of a field emission light source according to the invention.

In a possible embodiment, the glass structure 114 may be selected to form a lens for the field emission light source (e.g. being outward bulging), thereby possibly further enhancing the light extraction and mixing of light emitted from the field emission light source. It may also be possible to provide the glass structure with an anti-reflective coating. With reference to FIG. 3, an outward bulging structure has the additional advantage of at the same time allowing for an improved uniformity of the electrical field on the cathode as well as giving a uniform distribution of the electrons onto the first wavelength converting layer, thus improving the overall uniformity of the emitted light.

Turning now again to FIG. 1, nano-patterning and/or roughening the exiting surface of the glass structure 114 through which the generated light is coupled out may be used. It may further be possible to reduce lateral optical modes leaking into the glass substrate and increase the light outcoupling. These patterns may include, but are not limited, to nanopillars, nanocones, and/or nanospheres. An example on such light extracting features is ZnO nanorods, typically 0.1-5 um high, 0.1-5 um wide and separated by 0.1-5 μm. In addition, nanoparticles may be placed between the glass and the wavelength converting layer.

However, as an alternative it may be possible to allow for a "patched" formation of the first 118 and the second 120 wavelength converting materials onto the ITO layer 116, as is shown in FIG. 2*b*. As may be seen, in this implementation the first 118 and the second 120 wavelength are formed in layered patches at least partly overlapping each other. In the illustrated embodiment, the patches are formed as at least partly overlapping circles, however any type of forms are possible and within the scope of the invention.

With reference again to FIG. 1, the nanostructures 104 can be grown on a wafer by a number of techniques. As the wafer material may be chosen for example to match thermal expansion coefficients of the other wafer materials, it is not necessarily an optimum material to use for nanostructure formation. Thus, a first step may be the preparation of the wafer 102, for example by applying a thin layer of a metal onto the wafer 102 in order to facilitate this growth. One technique involves allowing the wafer 102 to pass through a hydrothermal growth process for forming a plurality of ZnO nanorods 104. Other techniques for preparation and nanostructure growth are possible and within the scope of the invention.

During operation of the field emission light source 100, a power supply (not shown) is controlled to apply a voltage potential between the field emission cathode 106 and the ITO layer 116. The voltage potential is preferably between 0.1-20 kV, depending for example on the distance between the field emission cathode 106 and the anode structure 108, the sharpness, height and length relationship of the plurality of ZnO nanorods 104 and the desired performance optimization.

Electrons will be released from the outer end of the ZnO nanorods 104 and accelerated by the electric field towards the anode structure 108. Once the electrons are received by the first wavelength converting material 118, a first wavelength light will be emitted. The light with the first wavelength range will impinge onto the second wavelength converting material 120, generating light within the second wavelength range. Some parts of the light within the first wavelength range will together with light within the second wavelength range pass through the ITO layer 116 and through the glass structure 114 and thus out from the field emission light source 100.

With reference to FIG. 3, there is shown an alternative embodiment of a field emission light source 300. In a similar manner as in relation to the field emission light source 100 of FIG. 1, the field emission light source 300 comprises a wafer 102'. A difference in comparison to the wafer 102 provided in relation to the field emission light source 100 is that the wafer 102' comprises a recess 302. The nanostructures 104 are in the illustrated embodiment formed at a bottom surface 304 of the recess 302. The spacer 110 is provided to separate the anode structure 108 from the field emission cathode 106, forming an evacuated cavity 306. The height of the spacer 110 combined with the depth of the recess 302 creates the distance (D) between the field emission cathode 106 and the anode structure 108. The distance, D, may as mentioned above be selected to optimize the operational point of the field emission light source. In a possible embodiment the distance, D, is selected (in relation to the height of the nanostructures 112) such that the outer ends of the nanostructures 112 (almost) comes in direct contact with the first wavelength converting material 118.

In general relation to the invention and as illustrated in FIG. 3, the first wavelength converting material comprises zinc sulfide (ZnS) configured to absorb electrons emitted by the nanostructures 104 and to emit blue light.

In the illustrated embodiment, the field emission light source 300 is further provided with light extracting elements 308 adapted to enhance light extraction out of the field emission light source 300. The light extraction elements 308 reduces the amount of trapped photons emitted from the first wavelength converting material 118 and thus improves the overall efficiency of the field emission light source 300.

The field emission light source 300 is further provided with a dome shaped structure 310 arranged at a distance from the glass structure 114. The inside surface of the dome shaped structure 310 facing the glass structure 114 and the light extracting elements 308 are provided with the second wavelength converting material 120. As discussed above, the second wavelength converting material 120 may comprise quantum dots (QDs) configured to absorb e.g. blue light emitted by the first wavelength converting material 118 and to emit e.g. green and/or yellow/orange and/or red light. Some portions of the blue light will pass through the second wavelength converting material 120, mix with the e.g. green and red light emitted by the second wavelength converting materials 120 and is thus be provided as white light emitted out from the field emission light source 300. One advantage with such an arrangement is that the second wavelength converting material will be subjected to less heat and therefore may be chosen also from materials that exhibit some temperature quenching in their light emission characteristics.

In the illustrated embodiment, a control unit 312 is shown as integrated with the wafer 102'. The functionality of the control unit 312 may thus be formed in direct adjacent contact with the field emission cathode 106, possibly simplifying the control of the field emission light source 300. The control unit 312 and the remaining portions of the field emission cathode 106 are preferably manufactured in a combined process, such as in a combined CMOS process.

It is desirable to form an electrical interconnection pad (not shown) connected to the TCO/ITO layer 116 of the anode 108 for allowing the field emission light source 300 to be operated by means of and connected to a power supply (not shown). A separate electrical connection is in such a case provided between the cathode 106 and the power supply. In relation to the manufacturing process, it may be preferred to connect a bonding wire (not shown) between the interconnection pad of the TCO/ITO layer 116 and a dedicated and isolated portion of the wafer 102, the isolated portion forming a further interconnection pad for receiving the bonding wire. As such, the power supply may more easily be connected to the anode 108 and the cathode 106 of the field emission light source 300. In relation to e.g. a LED light source, the bonding wire may be selected to be in comparison much thinner. The reason for this is that the operational current of the field emission light source 300 is in comparison generally several orders of magnitude lower.

As discussed briefly above, it may be possible, and within the scope of the invention, to shape the top and bottom surfaces of the recess 302 to optimize both the uniformity of the electrical field on the nanostructures 112 and the corresponding uniformity of emitted electrons onto the anode 108. This may be achieved by allowing the bottom surface of the recess 302, to be formed such that the distance D will be (slightly) smaller at the center of the recess 302, or by allowing the top surface of the cavity (formed together with the anode 108) to be slightly recessed so that the distance D will be (slightly) larger at center of the cavity 302. The concept of shaping the overall structure/shape of the field emission cathode 106 in spatial relation to the anode 108 is further elaborated in EP 2784800, which is fully incorporated by reference. The protrusion is preferably circular as seen from the top.

Figure 4A:
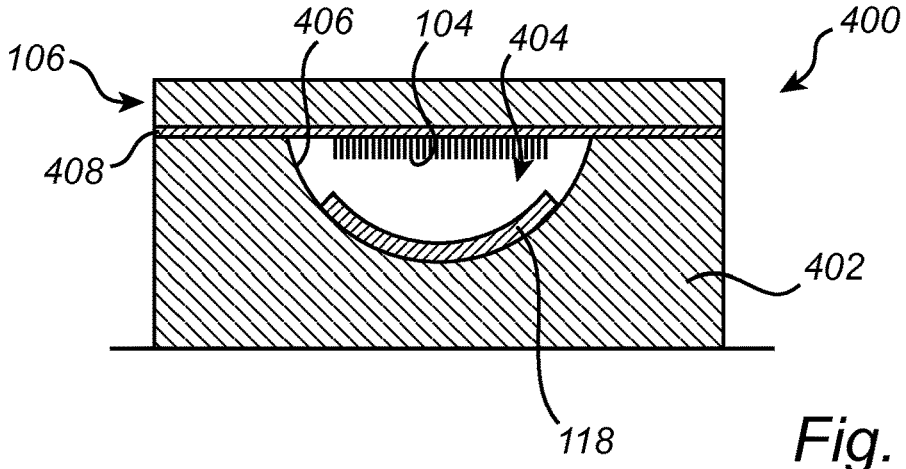
FIGS. 4*a*-4*d* provides further alternative embodiments of the field emission light source according to the invention.

Turning now to FIG. 4*a* which partially shows an alternative implementation of the field emission light source 300 as shown in FIG. 3. As a comparison, in FIG. 4*a*, an inverted approach to the field emission light source 400 is shown, where the nanostructures 104 of the field emission cathode 106 are arranged as a transmissive field emission cathode. Within the context of the present invention, the nanostructures 104 are, during operation emitting electrons in a direction towards an anode 402, formed from for example a metal material, such as for example aluminum, copper, steel or other similar materials.

Specifically, in accordance to the invention, a parabolic or near parabolic recess is arranged at the bottom wafer 402, forming a cavity 404 between the field emission cathode 106 and the bottom wafer 402. A surface 406 of the recess is arranged to be reflective, for example by means of the metal material forming the anode 402. One advantage with such an arrangement is that the heat transfer from the anode may be greatly enhanced.

In addition, the first wavelength converting material 118 is provided at the lower part of the recess/cavity 404. Thereby, during operation of the field emission light source 400, the electrons emitted from the field emission cathode 106 will be received by the first wavelength converting material 118. As a result of the reception of the electrons, the first wavelength converting material 118 will emit light (omnidirectional). The part of the light emitted downwards will in turn be reflected by the reflective surface 406 of the recess of the anode 402. The light will be reflected in a direction (back) towards the transmissive field emission cathode 106. Thus, light will be allowed to pass through the field emission cathode 106 and out from the field emission light source 400.

As discussed above, the light emitted from the first wavelength converting material 118 will be extracted/directed, e.g. by means of the parabolic recess, towards a second wavelength converting material 120 (not shown). At the second wavelength converting material 120, the received light will typically be converted to a higher wavelength range as compared to the wavelength range of light emitted from the first wavelength converting material 118.

In case of using a metal material for forming the anode 402, it may be necessary to further insulate the field emission cathode 106 from the anode 402. In such a scenario, an insulating layer 408 may be arranged in between the field emission cathode 106 and the anode 402. The thickness of the insulating layer may be selected depending on the voltage potential provided between the between the field emission cathode 106 and the anode 402 during operation of the field emission light source 400.

In a similar manner as discussed above in relation to FIG. 3, it may in accordance to the invention be possible to also shape the bottom or the top of the cavity for the purpose of improvements in relation to the uniformity of light emitted by the field emission lighting source 400 by forming a uniform reception of electrons from the cathode 106 towards the anode 108

Figure 4B:
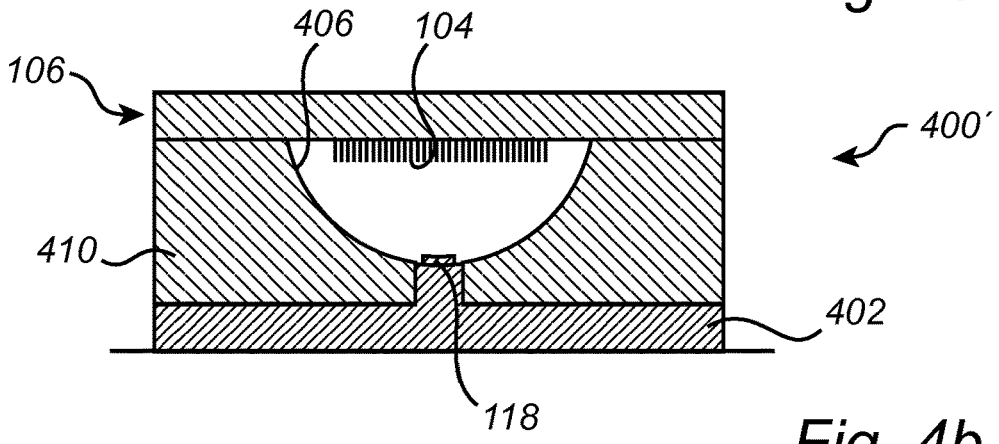

In a further alternative embodiment of the invention, with further reference to FIG. 4*b*, a field emission light source 400' similar to the field emission light source 400 of FIG. 4*a* is provided. The field emission light source 400' differs from field emission light source 400 of FIG. 4*a* in that the insulating layer 408 is substituted with an insulating spacer 410. However, in a similar manner as discussed above in relation to FIG. 4*a*, the insulating spacer 410 has a parabolic shape such that the cavity 404 is formed between the anode 402 and the field emission cathode 106. The insulating spacer 410 may in some implementations provide a further electrical separation between the anode 402 and the field emission cathode 106. It is however preferred to at least partly arrange a reflective coating (such as a separate reflective layer, e.g. being a metal layer) onto a portion of the parabolic inside surface forming the cavity 404.

Figure 4C:
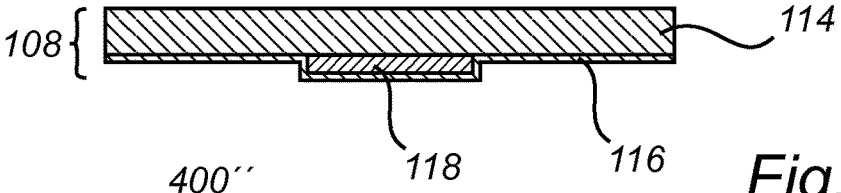

Turning again to FIG. 3, there may in accordance to the invention be possible to substitute the positioning of the conductive anode layer 116 and the first wavelength converting layer 118. That is, in accordance to the alternative embodiment shown in FIG. 4*c*, the first wavelength converting material is arranged directly adjacent to the glass structure 114. Accordingly, electrons emitted from the field emission cathode 106 in a direction towards the anode structure 108 will be received by the conductive anode layer 116, where the conductive layer 116 is arranged to have a voltage potential substantially differing from the field emission cathode 106 (i.e. in the range of kV). However, due to the inherent energy comprised with the electrons, they will at least party pass though the conductive anode layer 116 and impinge onto the first wavelength converting material 118. The present embodiment may in some instances be preferred as the conductive anode layer 116 at least partly "screens" the first wavelength converting material 118 from direct contact with high energy/velocity electrons emitted from the field emission cathode 106, thereby possibly improving the lifetime of the first wavelength converting material 118. The conductive anode layer 116 may in some instances comprise a transparent conductive material (TCO), for example comprising ITO. However, it may also be possible, and within the scope of the invention to form the conductive anode layer 116 from a metal layer, for example deposited onto the first wavelength converting material 118 and the glass structure 114. Such a metal layer is preferably selected for optimizing the amount of electrons passing through the metal layer, i.e. elements with low density, with a desired amount of light emitted from the first wavelength converting material 118. Such a layer should also at the same time exhibit a high reflectance so that light emitted from the first wavelength converting material 118 is directly reflected back and out of the structure. Such a layer will in addition also enhance the heat transfer capability of the structure.

Figure 4D:
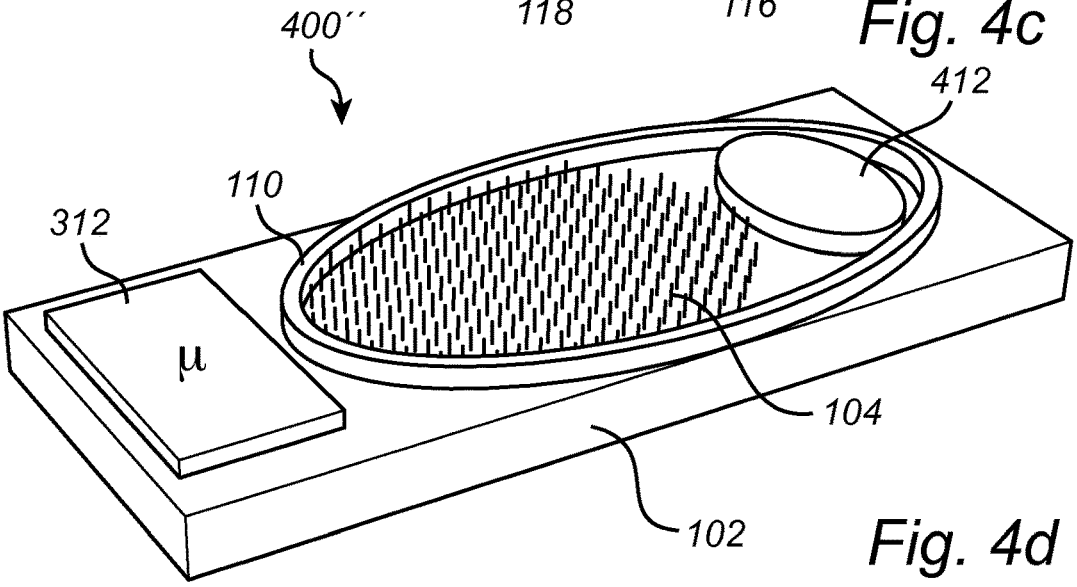

In FIG. 4*d* there is provided a perspective view of a field emission light source 400", having an essentially elliptic shape. An elliptical (or circular or similarly rounded) shape has advantages, for example in terms of avoiding electrical phenomena as arcing and parasitic currents. These may otherwise become an issue when high electrical fields are applied and corners or edges are present. The field emission light source 400" shows similarities to the field emission light source 100 in FIG. 1, with the addition of a getter 412. To achieve and sustain a vacuum of $1\times10^{-4}$ Torr or better, it is highly desirable to use the getter 412. The getter 402 is arranged adjacently to the nanostructures 114 at a bottom surface of the cavity 112 formed by the spacer structure 110 surrounding the nanostructures 114 and the getter 402. The getter is a deposit of reactive material that is provided for completing and maintaining the vacuum within the cavity 112. It is preferred to select the getter 410 to at least partly provide to the extraction of light out from the field emission light source 400". Thus, it is preferred to form the getter from a material having reflective properties. In addition, it is preferred that the surface from which the nanostructures 114 are provided is also arranged to be reflective. The activation of the getter 412 will generally take place once the device is sealed which in turn impose requirements on the temperature budget of the process once the getters have been placed in the device. In a similar manner as discussed above in relation to FIG. 3*a*, the control unit 312 may be integrated with the wafer 102. The functionality of the control unit 312 may thus be formed in direct adjacent contact with the nanostructures 114 of the field emission cathode for controlling the field emission light source 400".

Figure 5:
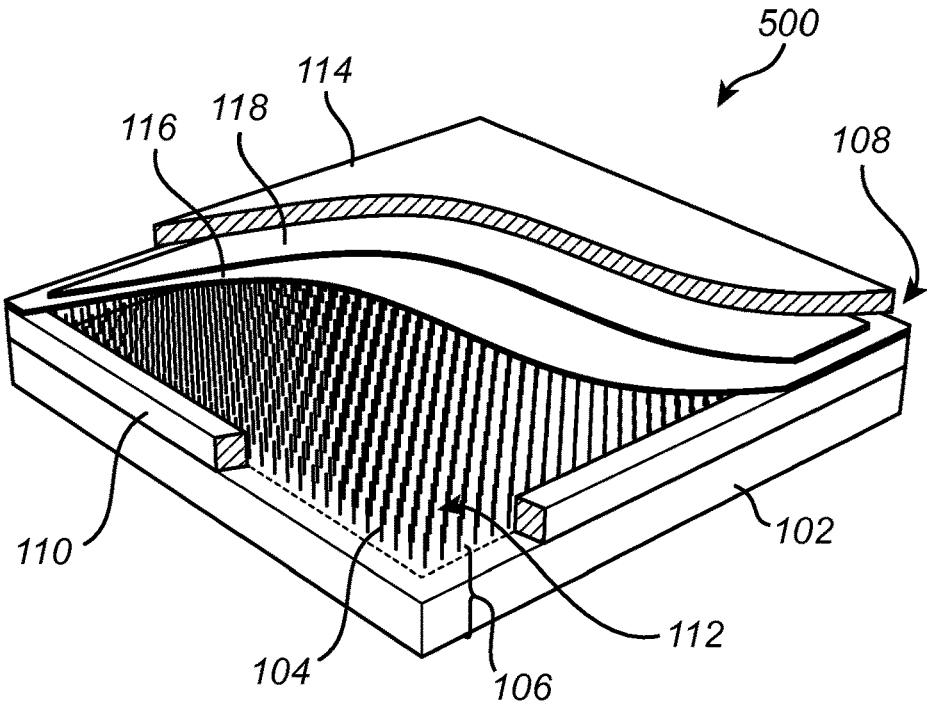
FIG. 5 illustrates an alternative implementation of a field emission light source according to the invention.

In an embodiment of the invention, with further reference to FIG. 5, a field emission light source 500 is provided. In FIG. 5, the first wavelength converting material 118 is arranged directly adjacent to the glass structure 114, thus sandwiched between the glass structure 114 and the conductive anode layer 116. In a similar manner as in regards to FIG. 4*c*, during operation, electrons will pass though the conductive anode layer 116 and impinge onto the first wavelength converting material 118. The conductive anode layer 116 is in such an embodiment preferably selected to be reflective, thereby reducing any light generated at the first wavelength converting material 118 be emitted "back" towards the cathode structure 106, thereby improving the overall light output from the field emission light source 500.

When using an anode with a layer of a conductive reflective layer, several aspects are of importance. The layer should be thin enough, so that electrons, impacting on the anode will pass through the layer without losing any significant portion of the energy; if that happens this energy will not be converted into photons and is lost resulting in an overall reduced energy efficiency.

On the other hand the layer must be thick enough so that the reflectance has reached an acceptable level; if it is too low, a significant portion of the photons will be absorbed or transmitted back towards the cathode and even if they would all be reflected back the overall losses would be significant.

There are two preferred metals for this, layer namely Ag (Silver) and Al (Aluminum). Of the two the latter is lower cost, a lighter element (allowing for thicker layers and has high reflectance both for UVC light and visible light, and is easier to implement as its oxide is thin, essentially transparent to visible light.

The energy used for consumer applications should be less than 10 kV and preferably less than 8.5 kV or soft X-rays generated by Brehmsstrahlung will be able to escape the lamp (it is otherwise absorbed by the anode glass). However these levels are to some extent depending on glass thickness, thus higher voltages can be allowed if a thicker glass is used.

On the other hand the energy must be high enough to penetrate the conductive and reflecting layer. A preferred range for consumer applications is thus 5-8 kV and 5-15 kV for industrial applications (where some soft X-rays can be accepted).

The operating energy (operating voltage is primarily set by the nanostructure detailed geometry (height, width/minimum radius, distance) and the distance between the cathode and the anode. The latter is determined by the cathode nanostructure height and the thickness of the spacer element. The dimensions of the spacer element therefore becomes critically important and may be used to set the operating voltage as it is desired to keep the nanostructure geometry constant since this process is much more tedious to modulate in an accurate way as compared to changing the spacer thickness for different application requirements.

Figure 6:
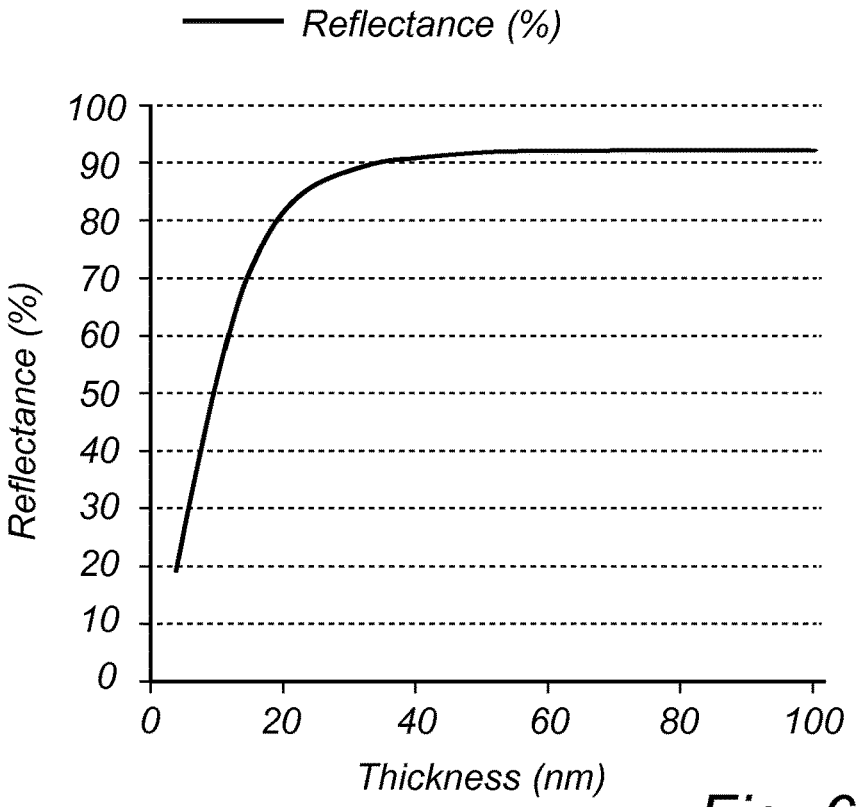
FIG. 6 shows a diagram with a reflectance curve for a conductive anode layer.

For Aluminum the thickness of the reflective and electrically conductive layer is determined to be in the range of 50-100 nm. A reflectance curve is shown in FIG. 6. As can be seen the reflectance reaches its steady maximum value above 50 nm. Allowing for some thickness variation over the surface a target value should be set to 60-70 nm as the low end and 90-110 nm as the high end, all depending on the exact desired operating voltage, in turn determined by the application.

It should be noted that higher operating voltages may be beneficial since, using a given input power requirement, a higher voltage leads to lower current densities. The current density is directly related to the intensity degeneration of the phosphor through, where a subjected accumulated charge is considered the primary cause for this degeneration. The lifetime is usually set by a 30% reduction of the initial intensity. A secondary benefit of using a higher energy is that the efficiency usually increases with higher voltages, likely because the photons are generated deeper into the cathodoluminescent crystallite and a lower fraction of electrons (especially secondary electrons) reach the surface of the crystallite where a non-radiative recombination process will occur.

Figure 7:
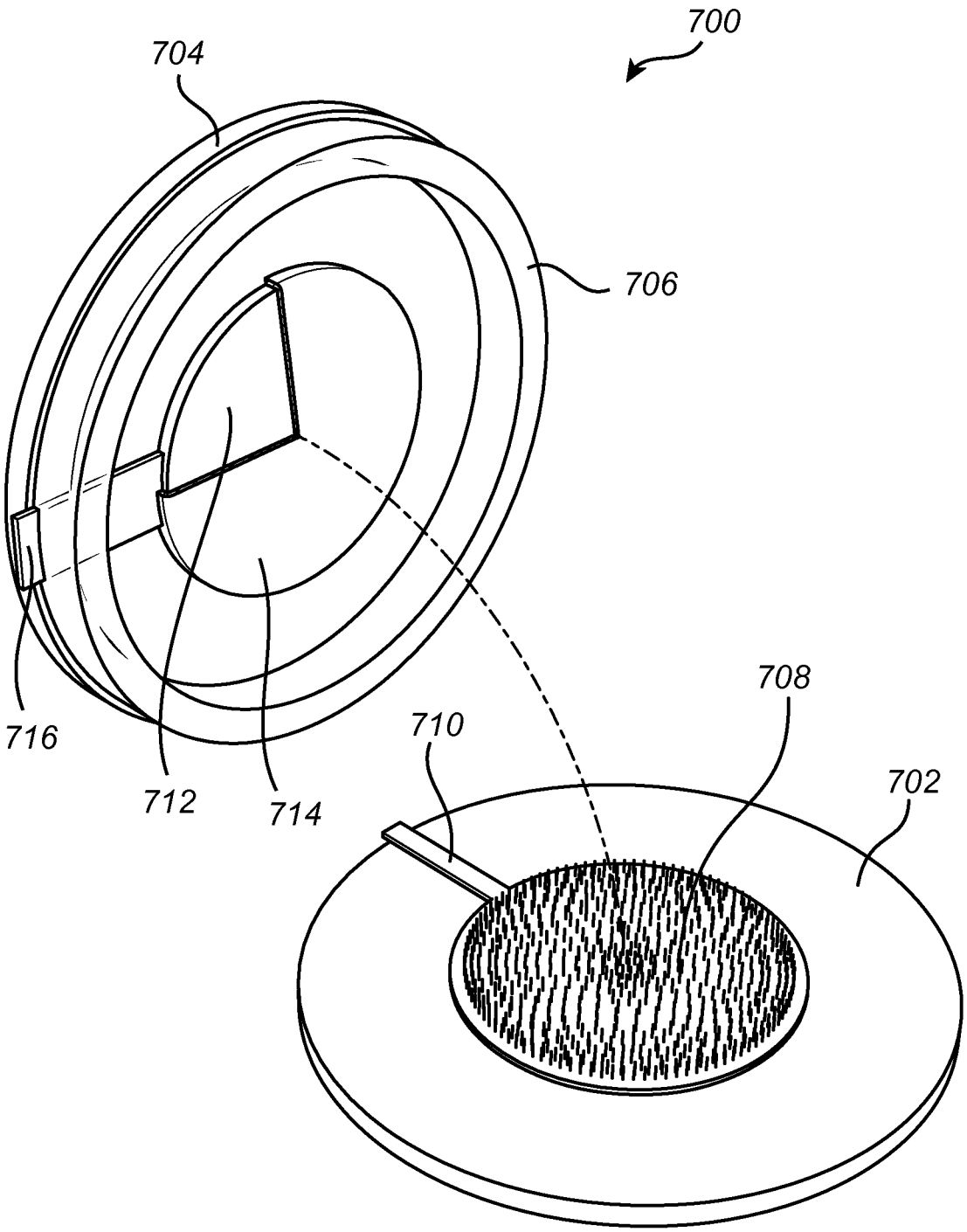
FIG. 7 illustrates a currently preferred implementation of a field emission light source according to the invention.

FIG. 7 illustrates a currently preferred implementation of a field emission light source 700 according to the invention. In the illustrated embodiment, the field emission light source 700 comprises a circular glass wafer 702 arranged at the bottom and a circular anode glass substrate 704 arranged at the top. A spacer 706 of a glass material and form as a glass ring is arranged between the glass wafer 702 and the anode glass substrate 704.

The glass wafer 702 is provided with a field emission cathode 708 comprising a plurality of nanostructures. A connecting element 710, for example provided using an ITO patch is provided for allowing electrical connection to the field emission cathode 708, i.e. extending beyond and outside the "wall" of the spacer 706.

The anode glass substrate 704 is provided with a first wavelength converting material 712, where the first wavelength converting material 712 is sandwiched between the anode glass substrate 704 and a metal layer 714 functioning as an electrically conductive anode. An ITO patch 716 is again provided for allowing electrical connection to the anode layer 714 and extending beyond and outside the wall of the spacer 706.

The field emission light source 700 may for example be manufactured by modularly arranging the components on top of each other in a high vacuum heated environment. Sealing of the glass component is preferably achieved as discussed above. The functionality of the field emission light source 700 is comparable to the field emission light sources 100 and 500 as discussed above.

Figure 8:
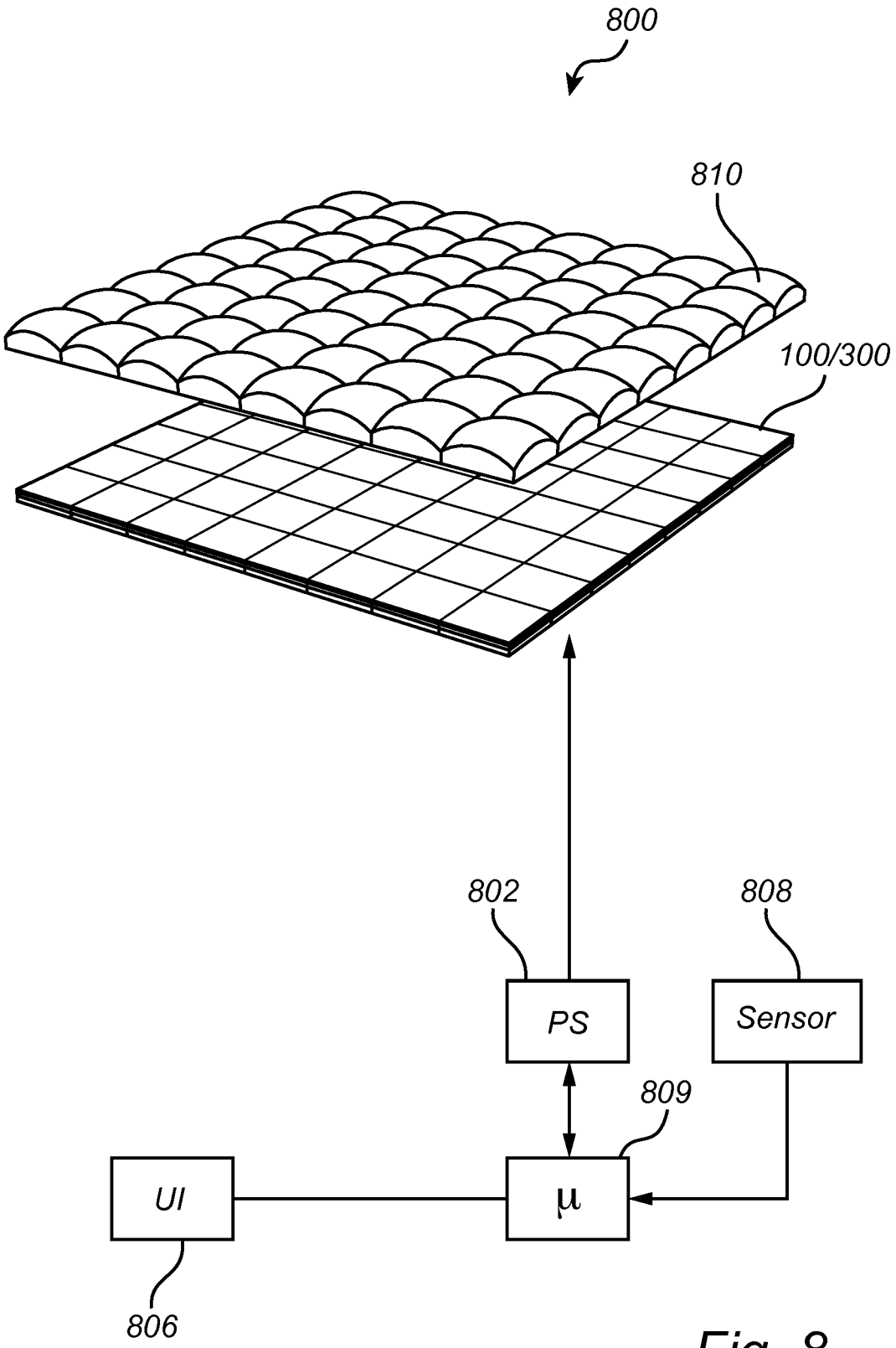
FIG. 8 illustrates a lighting arrangement comprising a plurality of field emission light sources arranged adjacently to each other.

Furthermore, in a possible embodiment of the invention, with further reference to FIG. 8, a lighting arrangement 800 may be formed by a plurality of adjacently arranged filed emission light sources 100/300/400/400'/400"/500/700 as discussed above. The field emission light sources 100/300/400/400'/400"/500/700 may be powered by a common power source 302, in turn controlled using a control unit 804. The control unit 804 may be configured to receive an indication of a desired intensity level from a user interface 806. In addition, a sensor 808 may be electrically connected to the control unit 804. The control unit 804 may be configured to control the power supply 802 depending on the desired intensity level and an intermediate intensity level measured using the sensor 808. The lighting arrangement 800 may additionally be provided with a lens structure 810 for mixing light emitted by the plurality of field emission light sources 100/300/400/400'/400"/500/700.

In summary, the present invention relates to a field emission light source, comprising a field emission cathode comprising a plurality of nanostructures formed on a substrate, an electrically conductive anode structure comprising a first wavelength converting material arranged to cover at least a portion of the anode structure, wherein the first wavelength converting material is configured to receive electrons emitted from the field emission cathode and to emit light of a first wavelength range, means for forming an hermetically sealed and subsequently evacuated cavity between the substrate of the field emission cathode and the anode structure, and a spacer structure arranged to encircle the plurality of nanostructures, wherein the cavity is evacuated and the substrate for receiving the plurality of nanostructures is a wafer.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps. Additionally, even though the invention has been described with reference to specific exemplifying embodiments thereof, many different alterations, modifications and the like will become apparent for those skilled in the art.

Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A field emission light source chip configured to emit ultraviolet (UV) light, comprising:

a field emission cathode comprising a plurality of zinc oxide (ZnO) nanostructures formed on a substrate, the substrate being adapted for a modular manufacturing process;

an anode structure comprising:

a transparent substrate, a first wavelength converting material arranged to cover at least a portion of the anode structure, wherein the first wavelength converting material is arranged directly adjacent to the transparent structure and is configured to receive electrons emitted from the field emission cathode and to emit light of a first wavelength range, and a conductive anode layer composed of a light reflective aluminum layer deposited onto the first wavelength converting material, wherein the conductive anode layer during use is arranged to have a voltage potential differing from the field emission cathode, whereby the electrons emitted from the field emission cathode will pass through the conductive anode layer before being received by the first wavelength converting material; and a spacer structure arranged to:

encircle the plurality of nanostructures, set a predetermined distance between the anode structure and the field emission cathode, and form a hermetically sealed and subsequently evacuated cavity between the substrate of the field emission cathode and the anode structure.

2. The field emission light source according to claim 1, further comprising a second wavelength converting material.

3. The field emission light source according to claim 2, wherein the first wavelength converting material comprises a phosphor material, and the second wavelength converting material comprises quantum dots generating light at a second wavelength range when receiving light at the first wavelength range, where the second wavelength range is at least partly higher than the first wavelength range.

4. The field emission light source according to claim 3, wherein the first wavelength range is between 350 nm and 550 nm, preferably between 420 nm and 495 nm.

5. The field emission light source according to claim 3, wherein the second wavelength range is between 470 nm and 800 nm, preferably between 490 nm and 780 nm.

6. The field emission light source according to claim 2, further comprising a third wavelength converting material, emitting light within a third wavelength range.

7. The field emission light source according to claim 1, further comprising a second wavelength converting material arranged remotely from the first wavelength converting material.

8. The field emission light source according to claim 7, further comprising a dome shaped structure arranged on an outside of the anode structure, wherein the second wavelength converting material is formed on at least a portion of an inside of the dome shaped structure.

9. The field emission light source according to claim 1, wherein a light outcoupling side of at least one of the substrate of the field emission cathode and the anode substrate comprises light extraction nanostructures.

10. The field emission light source according to claim 1, wherein the wafer is a metallic alloy.

11. The field emission light source according to claim 1, wherein the plurality of nanostructures have a length of at least 1 um.

12. The field emission light source according to claim 1, wherein the predetermined distance between the substrate of the field emission cathode and the anode structure to be between 100 um and 5000 um.

13. The field emission light source according to claim 1, wherein the predetermined distance between the field emission cathode and the anode structure is dependent on a desired operational point of the field emission light source.

14. The field emission light source according to claim 1, wherein the wafer comprises a recess, and at least a portion of the plurality of nanostructures are formed at a bottom surface of the recess.

15. The field emission light source according to claim 1, wherein the first wavelength converting material comprises zinc sulfide (ZnS) and the first wavelength converting material is configured to absorb electrons and emit blue light, or the first wavelength converting material comprises a mono crystalline phosphor layer.

16. The field emission light source according to claim 1, wherein the wafer is a silicon wafer, and logic functionality for controlling the field emission light source is formed with the silicon wafer.

17. The field emission light source according to claim 1, wherein the wafer is manufactured from a metal material.

18. The field emission light source according to claim 1, further comprising a getter arranged adjacently to the nanostructures.

19. A lighting arrangement, comprising:

the field emission light source according to claim 1, a power supply for supplying electrical energy to the field emission light source for allowing emission of electrons from the plurality of nanostructures towards the anode structure, and a control unit for controlling the operation of the lighting arrangement.

20. The field emission light source according to claim 1, wherein the field emission cathode further comprises a metal layer arranged onto the substrate, wherein the nanostructures comprise ZnO nanorods, and the ZnO nanorods are formed on the metal layer.

* * * * *